US005390979A

United States Patent [19]

Corlett

[11] Patent Number: 5,390,979

[45] Date of Patent: Feb. 21, 1995

[54] ADJUSTABLE CHAIR

[75] Inventor: Esmond N. Corlett, Nottingham, England

[73] Assignee: British Technology Group Ltd., London, England

[21] Appl. No.: 866,039

[22] Filed: Apr. 10, 1992

Related U.S. Application Data

[63] Continuation-in-part of Ser. No. 774,735, Oct. 10, 1991, Pat. No. 5,253,922, which is a continuation of Ser. No. 442,696, Nov. 29, 1989, abandoned, which is a continuation-in-part of Ser. No. 197,002, May 23, 1988, abandoned.

[30] Foreign Application Priority Data

Apr. 11, 1991 [GB] United Kingdom ..... 9107661

[51] Int. Cl.[6] ..... A47C 3/00

[52] U.S. Cl. ..... 297/344.12; 297/328; 297/330; 297/338

[58] Field of Search ..... 297/345, 313, 328, 337, 297/338, 300, 325–327, 195.11, 330, 339, 344.1; 248/397, 407

[56] References Cited

U.S. PATENT DOCUMENTS

| | | | |
|---|---|---|---|
| 2,836,225 | 5/1958 | Swenson | 248/397 |
| 4,387,876 | 6/1983 | Nathan | 297/345 X |
| 4,561,621 | 12/1985 | Hill | 297/328 X |
| 4,664,445 | 5/1987 | Groseth | 297/328 X |
| 4,767,156 | 8/1988 | Yamada et al. | 248/397 X |
| 4,779,925 | 10/1988 | Heinzel | 297/345 X |
| 4,805,865 | 2/1989 | Goforth | 248/397 X |
| 4,979,778 | 12/1990 | Shields | 297/300 X |
| 5,253,922 | 10/1993 | Corlett | 297/344.16 |

FOREIGN PATENT DOCUMENTS

| | | | |
|---|---|---|---|
| 0293136 | 5/1988 | European Pat. Off. . | |
| 1630781 | 1/1979 | Germany | 248/397 |
| 2733322 | 2/1979 | Germany | 297/300 |
| 9000426 | 1/1990 | Germany . | |
| 2226756 | 11/1989 | United Kingdom . | |
| 2205737 | 4/1991 | United Kingdom . | |

*Primary Examiner*—Peter M. Cuomo
*Assistant Examiner*—Suzanne L. Dino
*Attorney, Agent, or Firm*—Cushman, Darby & Cushman

[57] ABSTRACT

In a chair having a seat which is adjustable in both height and tilt, there is provided a simplified adjustment mechanism over prior art document 2226756-A, in which a first adjustment mechanism is provided to tilt the seat of the chair to suit the physique of a particular user, which mechanism is compatible, and used in conjunction with a second adjustment mechanism which is used to vary both height and tilt of the seat cooperatively to suit the specific requirements of said particular user for being in a seated, or semi-standing position at various heights.

9 Claims, 4 Drawing Sheets

ADJUSTABLE CHAIR

This application is a continuation-in-part of application Ser. No. 07/774,735, filed Oct. 10, 1991, now U.S. Pat. No. 5,253,922 issued Oct. 19, 1993, which was a continuation of application Ser. No. 07/442,696, filed Nov. 29, 1989, now abandoned, which in turn was a continuation-in-part of application Ser. No. 07/197,002, filed May 23, 1988, now abandoned.

The present invention relates to adjustable chairs, and more particularly to chairs having a seat which can be sat on at various heights whilst still allowing the user's feet to be on the floor. Such chairs are known as sit/-stand chairs. Such chairs provide a tilting mechanism for the seat of the chair.

A known chair of this type is described in UK Patent Application 2226756-A, in which a spring and release lever are provided as a first adjusting mechanism for altering the height of the seat independent of any tilting motion, and a pneumatic piston is provided as a second adjusting mechanism for simultaneously altering both the height of the seat and its tilt, to allow the user to sit on the chair at various heights.

In that instance, the first adjusting mechanism is used to facilitate adjustment of the chair to be appropriate to any particular user of the chair; the second adjusting mechanism is then used to facilitate adjustment of the chair for that said particular user to be able to be seated at various heights whilst the user's feet remain in contact with, for example, the floor.

Though this chair is fully adjustable, it is relatively complex and therefore expensive to produce.

The present invention is directed towards a modified adjusting mechanism which provides the necessary adjustment of the tilt and height of the seat of the chair, said modified adjusting mechanism being simplified over the prior art.

The present invention provides a chair for supporting a user in a sitting or semi-standing position, including a seat, said chair having cooperative means for adjusting the tilt and height of the seat simultaneously and the tilt of the seat being further independently alterable. In a preferred embodiment, the modified adjusting mechanism includes a first adjusting mechanism by which any particular user may initially adjust the chair to correspond to their physique, using a lever possibly with a graduated scale, and a second adjusting mechanism which operates such that subsequent seat height adjustment is automatically accompanied by a corresponding seat tilting action also suited to the particular user.

Further advantages which may be realised by use of the present invention, particularly over that described in 2226756-A, are cost savings in manufacture of such a chair, and reduced weight of the chair because a spring mechanism, or equivalent such as a second piston and associated linkages and operating means as described in 2226756-A are not necessary.

Embodiments of the present invention will now be described by way of example with reference to the accompanying drawings, in which.

Figure 2:
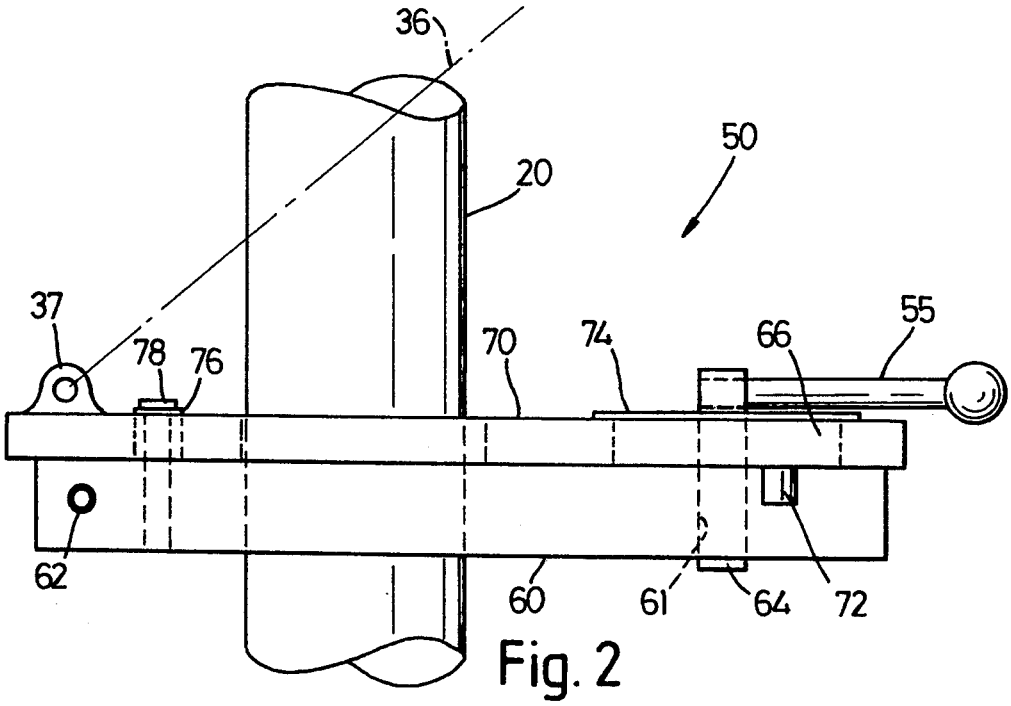
FIG. 2 shows a side elevation in greater detail on adjustment mechanism suitable for the chair of FIG. 1.
Figure 3:
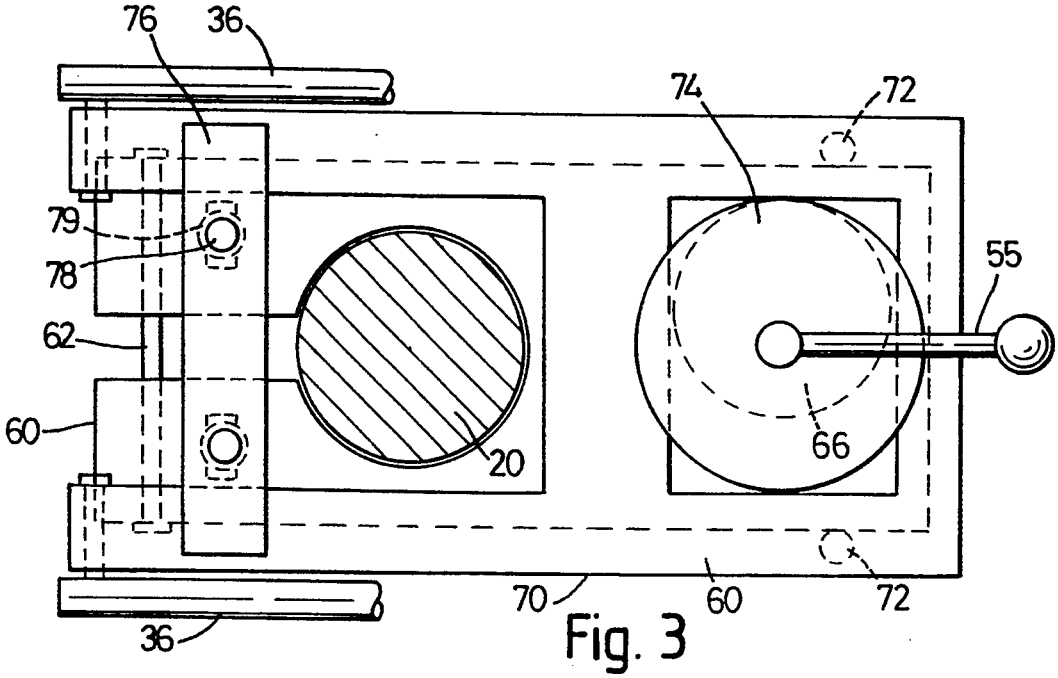

FIG. 3 the mechanism of FIG. 2 in plan view.

Figure 4:
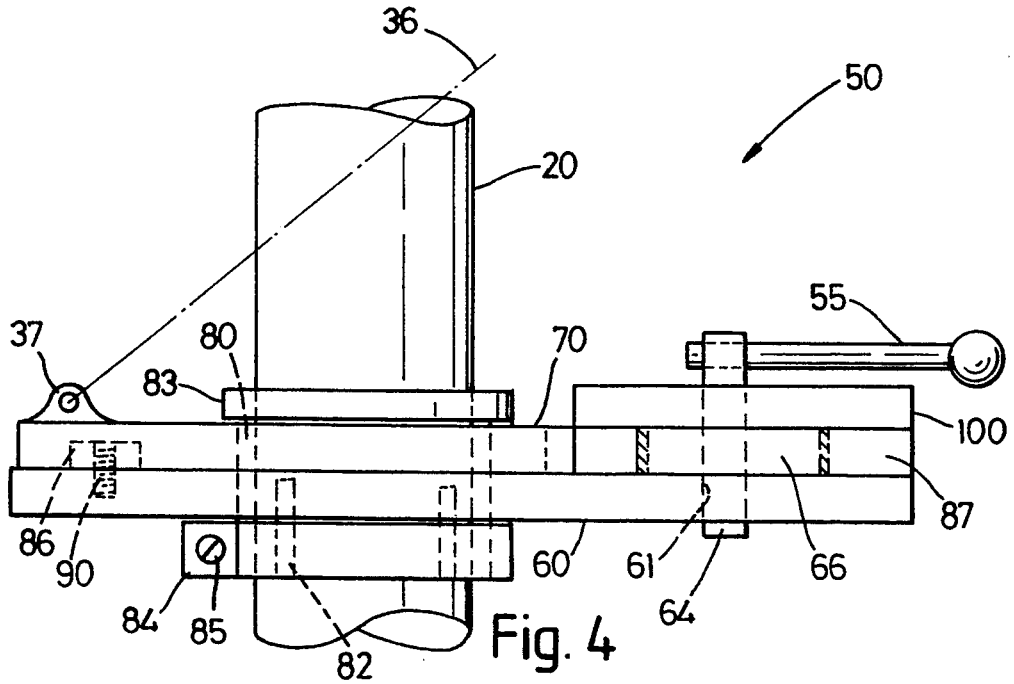
Figure 5:
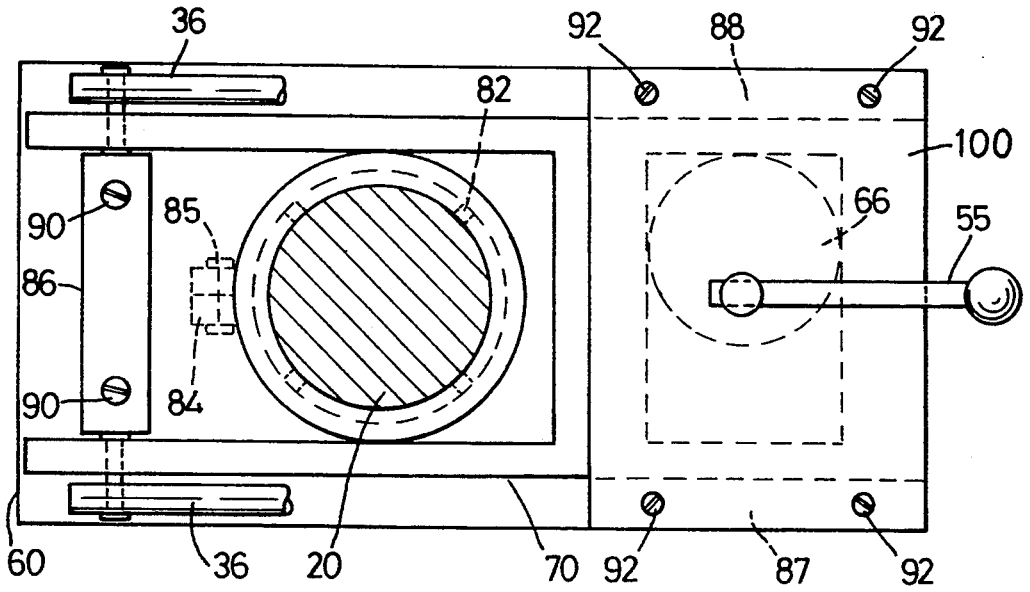

FIGS. 4 and 5 show in side elevation and plan view an alternative embodiment of the adjustment mechanism.

Figure 6:
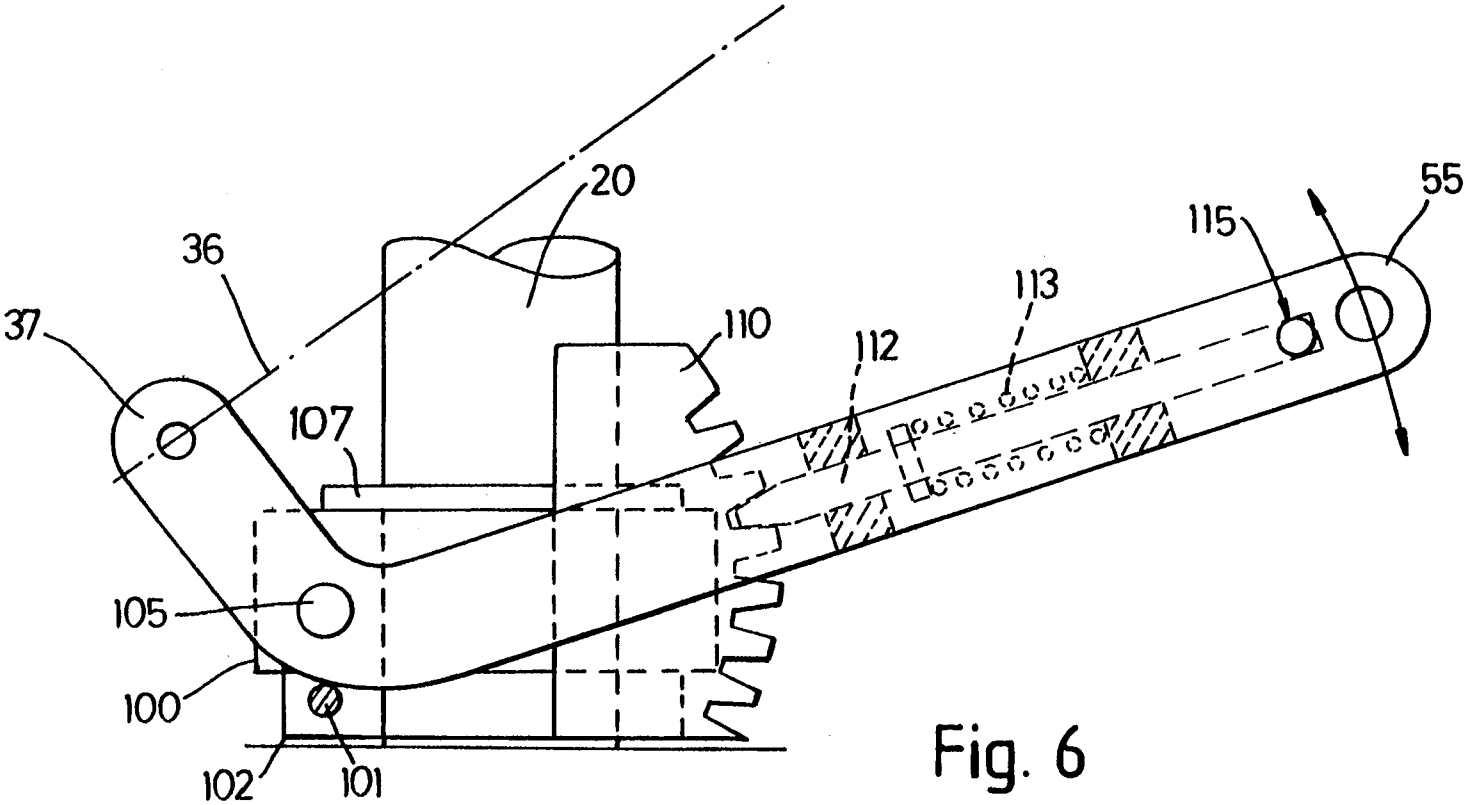

FIG. 6 shows in side elevation a further alternative embodiment of the adjusting mechanism.

Figure 1:
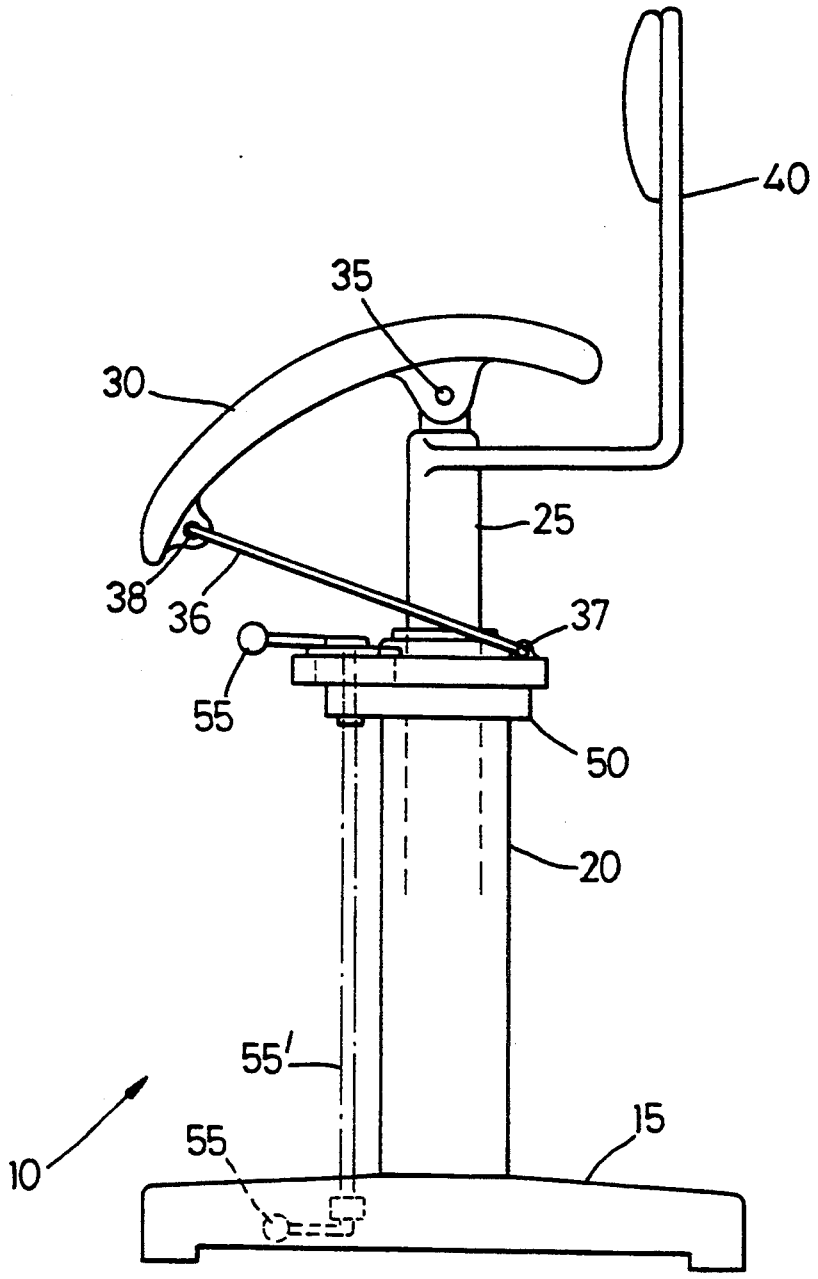
FIG. 1 shows in side elevation a chair according to the present, invention.

Referring to FIG. 1, there is shown a chair 10 having a seat 30, back restraint 40, and base 15.

The base 15 may be of known type having a five star arrangement of feet providing a stable base when the weight on the chair is within the area of the base. For clarity, only two feet are represented in FIG. 1. The base 15 may further include the outer casing 20 of a gas cylinder used in raising and lowering the seat.

The back restraint 40 may also be of known type affixed to the chair 10 as well known in the art.

The seat 30 may for example be of the type described in UK Patent Application No. 2226756A.

In the particular embodiment of FIG. 1, the seat 30 is supported at pivot 35 by gas cylinder piston 25 with the gas cylinder casing 20 being attached to base 15.

The tilting action of seat 30 is provided by an arm 36 coupled to a lug 38 attached to the seat, and to a lug 37 attached to adjusting mechanism 50. It can be seen in FIG. 1 that as the seat height is adjusted by means not shown) causing gas cylinder piston 25 to rise or fall, the tilt of the seat 30 is automatically adjusted.

With reference to FIGS. 2 and 3, an embodiment of the present invention provides the first adjusting mechanism 50 for adjusting the tilt of the seat 30 independent of height adjustment via piston 25.

Fixed plate 60 is clamped around gas cylinder 20, using bolt 62. A spindle 64 of an eccentric 66 rotates in a bearing hole 61 in plate 60, driven by handle 55. The eccentric 66 bears on the front and back of an opening in a linearly adjusting member such as sliding plate 70, which is guided by having a forked rear end sliding either side of gas cylinder 20, and guide pegs 72.

To prevent sliding plate 70 separating from fixed plate 60, a retaining washer 74 is bolted to the top of the eccentric 66, and retaining plate 76 crossing the two sides of the forked end of the sliding plate 70 is bolted to fixed plate 60 using bolts 78, with spacers 79 to give sliding clearance to sliding plate 70. One of the bolt holes in plate 76 is enlarged to allow the fixed plate 60 to be clamped to the gas cylinder 20. At the back of sliding plate 70 are two lugs 37 which are coupled to seat lugs 38 via arm 36 as shown in FIG. 1.

With reference to FIGS. 4 and 5, a further embodiment of the present invention is shown. This embodiment allows the seat to rotate, with the adjustment mechanism rotating with the seat.

Fixed plate 60 is rotatably mounted onto collar 80, collar 80 having slots 82 cut out in order that compression ring 84 can compress collar 80 around gas cylinder 20, using pinch bolt 85, thus preventing downward vertical movement of fixed plate 60 relative to the gas cylinder.

A spindle 64 of an eccentric 66 rotates in a bearing hole 61 in plate 60 operated by handle 55. The eccentric 66 bears on the front and back of an opening in a linearly adjusting member such as sliding plate 70, which is guided by having a forked rear end sliding on either side of collar 80, and by guiding bars 86, 87, 88.

Guide bar 86 is attached to fixed plate 60 using bolts 90. The guide bars 87, 88 further act as spacers allowing movement of sliding plate 70 beneath eccentric restraining plate 100, restraining plate 100 and guide bars 87, 88 being attached to fixed plate 60 using bolts 92.

Sliding plate 70 is restrained in an upward vertical direction by restraining plate 100 and collar 80 having a neck portion 83. A bearing hole is provided in restraining plate 100 for spindle 64 of eccentric 66.

In a typical application, the user of the chair first sets the seat to its lowest position using such mechanism as is provided, such as a lever coupled to gas cylinder 20, to cause gas cylinder 20 to lower gas cylinder piston 25 to its lowest position. The user then adjusts handle 55 until his/her feet are comfortably on the floor. From then on, only the gas cylinder adjustment is used to raise or lower the height of the seat with consequent automatic tilting action to suit the user. A graduated scale can be provided on the fixed plate 60 (or other suitable location) against which a user can compare the position of handle 55, thus enabling subsequent setting of the handle at an appropriate position for that particular user.

It will be evident that the first adjusting mechanism 50 could be constructed in a number of embodiments, and be oriented beneath the seat a number of ways. The mechanism 50 could be situated at the seat pan end (38) with lever 55 being situated under the seat. Alternatively lever 55 could be remotely located for example by means of a connecting lever 55' (shown dotted in FIG. 1) and be mounted adjacent to the five star base 15 or incorporated in one of the feet to produce adjustment by movement of one of the feet.

The sliding plate lug 37 could be situated on the same side of piston 25 as the seat lug 38, or lugs 37, 38 could be on opposing sides of piston 25. The handle 55 could be designed to protrude rearwards, forwards or sideways from the seat of the chair. There may be one or more occurrences of arm(s) 36 and lugs 37, 38.

The circumference of eccentric 66 need not be in the horizontal plane, but can be mounted in any orientation such that a rotary motion can be translated into an appropriate linear motion capable of tilting the seat.

The linearly adjusting member such as sliding plate 70 could alternatively be embodied as a plate with a toothed edge situated to be driven by a corresponding toothed wheel instead of an eccentric 66.

The effect of moving sliding plate 70 relative to fixed plate 60 is to alter the position of lug 38 relative to the central piston.

This can be achieved by a number of alternative embodiments.

It will be apparent that any apparatus which effects a shortening or lengthening of the distance of a lug 38 attached to the seat, and a lug 37 attached to a point on the base of the chair will achieve the desired linear movement of a first adjusting means.

Such apparatus could be embodied by a "lazy-tongs" or screw-jack type arrangement which effectively alters the length of linkage 36.

In any of the aforementioned embodiments, there may also be provided a means of locating or locking the handle means, or controlling the ease of movement of the handle.

A further embodiment of the present invention is shown in FIG. 6.

Collar 107 is attached to gas cylinder 20 using compression ring 102 and pinch bolt 101 in similar fashion to FIGS. 4 & 5. Plate 100 is rotatably mounted onto collar 107, being restrained in a downward vertical direction by compression ring 102.

Handle means 55 are pivotally mounted on plate 100 by pivot 105, handle means being lockable in a plurality of positions by ratchet plate 110 and corresponding locking pin 112, locking pin 112 having spring means 113, locking means being operated by a handle 115.

Rotation of handle 155 about pivot 105 results in corresponding movement of lug 37 to which is attached link 36 as in aforementioned embodiments.

It will be readily apparent to those skilled in the art that a considerable number of alternative embodiments of the first adjusting mechanism are possible without departing from the spirit or scope of the present invention.

I claim:

1. A chair for supporting a user in one of a sitting and semi-standing position, including:

a seat, said chair having co-operative adjustment means for simultaneously adjusting tilt of the seat and the height of the seat, and second independent adjustment means for adjusting only tilt of the seat independently of the co-operative adjustment means.

2. A chair as described in claim 1 wherein said second independent adjustment means are provided as a handle means.

3. A chair as described in claim 2 wherein said handle means are coupled to an eccentric drive means, in which a machined plate is provided that is slidably mounted in support guides, wherein said eccentric drive means is operatively connected to said machined plate to cause said machined plate to slide within said support guides as the position of said handle means is adjusted, and wherein said second independent adjustment means comprises lever means disposed between said machined plate and said seat such that sliding movement of said machined plate within said support guides adjust an angle of tilt of the seat.

4. A chair as described in claim 1 wherein co-operative said adjustment means operates to impel a linearly adjusting member coupled to the seat to provide the necessary tilting movement of the seat.

5. A chair as in claim 2 wherein said handle means are coupled to a toothed wheel, said toothed wheel being situated to drive a corresponding toothed edge of a linearly adjusting member.

6. A chair as described in claim 1 or 2 wherein the independent adjustment means are provided by a mechanical link coupled at one end to the seat, and coupled at the other end to a base of the chair, said mechanical link capable of being shortened or lengthened with respect to the one end coupled to the seat, and the other end coupled to the base of the chair.

7. A chair as described in any of claim 2 wherein said handle means is provided with one of locating means, locking means, and means for controlling the ease of movement of said handle.

8. A chair as claimed in claim 3 wherein a fixed plate is rigidly attached to a base of the seat, the machined plate is mounted on the fixed plate, the eccentric drive means being operative to push the machined plate in one of two possible directions.

9. A chair for supporting a user in one of a sitting and semi-standing position, including:

a seat, said chair having co-operative adjustment means for simultaneously adjusting tilt of the seat and height of the seat, and second independent adjustment means for adjusting only tilt of the seat, wherein said second independent adjustment means is provided with a handle means operatively coupled to drive a linearly adjusting member, said .member being coupled to the seat such that said handle means provides said second independent adjustment means.

* * * * *